US006412228B1

(12) United States Patent
Meckstroth

(10) Patent No.: US 6,412,228 B1
(45) Date of Patent: Jul. 2, 2002

(54) LEAF AND DEBRIS DEFLECTING COVER DEVICE FOR A RAIN GUTTER

(76) Inventor: Alan F. Meckstroth, 2357 Shelterwood Dr., Dayton, OH (US) 45419

( * ) Notice: Subject to any disclaimer, the term of this patent is extended or adjusted under 35 U.S.C. 154(b) by 0 days.

(21) Appl. No.: 09/512,051

(22) Filed: Feb. 24, 2000

(51) Int. Cl.[7] ..... E04D 13/076

(52) U.S. Cl. ..... 52/12; 52/11; 248/48.1; 210/474

(58) Field of Search ..... 52/12, 11; 248/48.1; 210/474

(56) References Cited

U.S. PATENT DOCUMENTS 5,181,350 A * 1/1993 Mechstroth ..... 52/12
5,375,379 A * 12/1994 Meckstroth ..... 52/12
5,459,965 A * 10/1995 Meckstroth ..... 52/12
6,098,345 A * 8/2000 Demartini et al. ..... 52/12

* cited by examiner

*Primary Examiner*—Carl D. Friedman
*Assistant Examiner*—Christy M. Green
(74) *Attorney, Agent, or Firm*—Jacox, Meckstroth & Jenkins

(57) ABSTRACT

An open top rain gutter has a front wall with an upper return flange and is mounted on a fascia board below a roof covering. The gutter is covered by an elongated cover device or strip formed or extruded of a semi-rigid plastics material having a generally uniform thickness. The cover strip includes a flat inner portion adapted to project under the rood covering, and a generally flat first intermediate portion projects over the gutter and is integrally connected to a second intermediate portion by a first thin flexible hinge section to provide for accommodating a sloping gutter. The second intermediate portion is integrally connected to an outer flange portion mounted on the return flange of the gutter and includes a nose above the outer flange portion and an inclined channel having bottom slots below the outer flange portion. The outer flange portion projects from the gutter to form a lip portion, and a second thin flexible hinge section integrally connects the first intermediate portion to the inner portion for accommodating different roof pitches.

2 Claims, 2 Drawing Sheets

32
48
54
30
45
52
34
26
62
72
64
68
58
24
78
71
21
76
14
19
18
10
16

32
48
45
54
30
52
62
72
64
58
68
34
26
78
71
21
76
24
19
18
14
10
16

LEAF AND DEBRIS DEFLECTING COVER DEVICE FOR A RAIN GUTTER

BACKGROUND OF THE INVENTION

The present invention is directed to an improved leaf and debris deflecting cover strip or device for a rain gutter and which has a construction similar to that disclosed in U.S. Pat. No. 5,459,965 which issued to the present applicant. As disclosed in the patent, an open top rain gutter has a front wall with an upper edge or channel portion and is mounted on the fascia board of a building directly under the outer edge portion of a roof covering. The cover device or strip may be formed as a one-piece extrusion of semi-rigid plastics material such as polyvinylchloride and with a generally uniform thickness. The strip includes a generally flat inner portion which projects under the roof covering and which continues outwardly to cover a substantial portion of the gutter for directing water received from the roof covering over the substantial portion of the gutter. The strip also includes a longitudinally extending outer flange and support portion which seats on the upper channel portion of the gutter and projects outwardly and downwardly from the channel portion to form a projecting flange or lip portion.

The outer portion of the strip is integrally connected to the inner portion of the strip by a longitudinally extending intermediate portion which has a longitudinally extending nose disposed above the outer portion of the strip and a longitudinally extending inclined channel having bottom openings or slots disposed below the outer portion of the strip and adjacent the upper channel portion of the gutter. The nose is effective to direct the water received from the inner portion downwardly into the channel by a coanda effect and through the slots into the gutter and is also effective to deflect leaves and other debris outwardly onto the outer portion of the strip and to the ground from the projecting lip portion. The generally flat and semi-rigid inner portion of the strip has sufficient strength to support heavy snow and ice loads and also prevents the buildup of ice dams within the gutter.

As illustrated in the above patent, the gutter cover device or extruded vinyl strip is preferably produced in elongated sections or strips having a length of several feet such as 3' or 4', and the sections are tilted on the upper channel portion of the gutter to accommodate different elevations of the gutter or a gutter which slopes relative to the roof covering. However, it has been found that as the gutter cover strips or sections are tilted at different angles along the length of a sloping gutter, slight undesirable steps are produced between the outer flange or lip portions of adjacent strips or sections. The different tilting of the gutter cover strips or sections also changes the angle of the inclined channel of each strip and prevents the channel from being at a uniform and optimum incline angle along the entire length of the gutter to ensure that small leaves and debris are deflected to the outer portion of each strip.

It is known to form perforated plastic gutter covers or strips from thin flexible material or with a thin flexible hinge section along the inner portion of the gutter cover which projects under the roof covering to accommodate different roof pitches. However, such gutter covers become distorted or concaved in time and do not provide the advantages of the gutter cover device disclosed in the above-mentioned patent.

SUMMARY OF THE INVENTION

The present invention is directed to an improved cover device for deflecting leaves and other debris over an open top rain gutter to the ground and for directing rain water from a roof covering into the gutter. The gutter cover or device of the invention solves the problems described above and provides an effective gutter cover which can be efficiently produced in elongated strips or sections and can be quickly installed so that all of the sections along the length of a gutter have a uniform position and appearance with respect to the upper edge portion of the gutter along its entire length regardless of the elevation of the gutter relative to the roof covering.

In accordance with a preferred embodiment of the invention, an elongated gutter section or strip is extruded of a semi-rigid plastics material and includes a generally flat inner portion which projects under the roof covering. The inner portion is integrally connected by a thin flexible hinge section to a generally flat first intermediate portion which continues outwardly from the inner portion to cover a substantial portion of the gutter and to direct water received from the roof covering over a substantial portion of the gutter. Each strip or section also includes a longitudinally extending outer support portion positioned to seat on the upper edge portion of the gutter. A longitudinally extending second intermediate portion is integrally connected to the outer portion and is also integrally connected to the first intermediate portion by a second thin flexible hinge section having a thickness substantially thinner than the thickness of the first intermediate portion.

The second intermediate portion includes a longitudinally extending nose disposed above the outer portion of the strip and a longitudinally extending inclined channel having longitudinally spaced openings or slots below the outer portion of the strip and adjacent the upper edge or channel portion of the gutter. The nose directs the water received from the first intermediate portion of the strip downwardly into the channel and into the gutter through the slots and deflect leaves and other debris outwardly onto the outer portion of the strip for falling to the ground. The first flexible hinge section of the strip provides for accommodating roofs of different pitches. The second flexible hinge section provides for pivoting the first intermediate portion relative to the second intermediate portion for accommodating a sloping gutter with a changing elevation relative to the roof covering without pivoting the outer portion and the second intermediate portion of the strip relative to the gutter.

Other features and advantages of the invention will be apparent from the following description, the accompanying drawings and the appended claims.

DESCRIPTION OF THE PREFERRED EMBODIMENT

Figure 1:
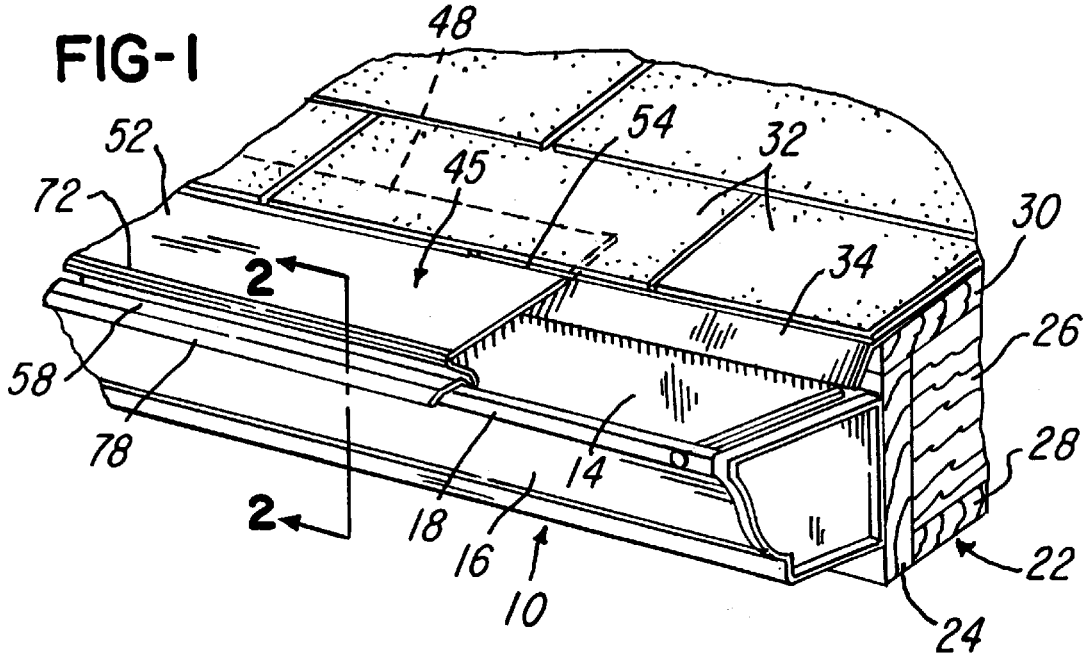
FIG. 1 is a perspective view of an improved gutter cover constructed in accordance with the invention and shown installed on a gutter mounted on a roof eave under a roof covering.
Figure 2:
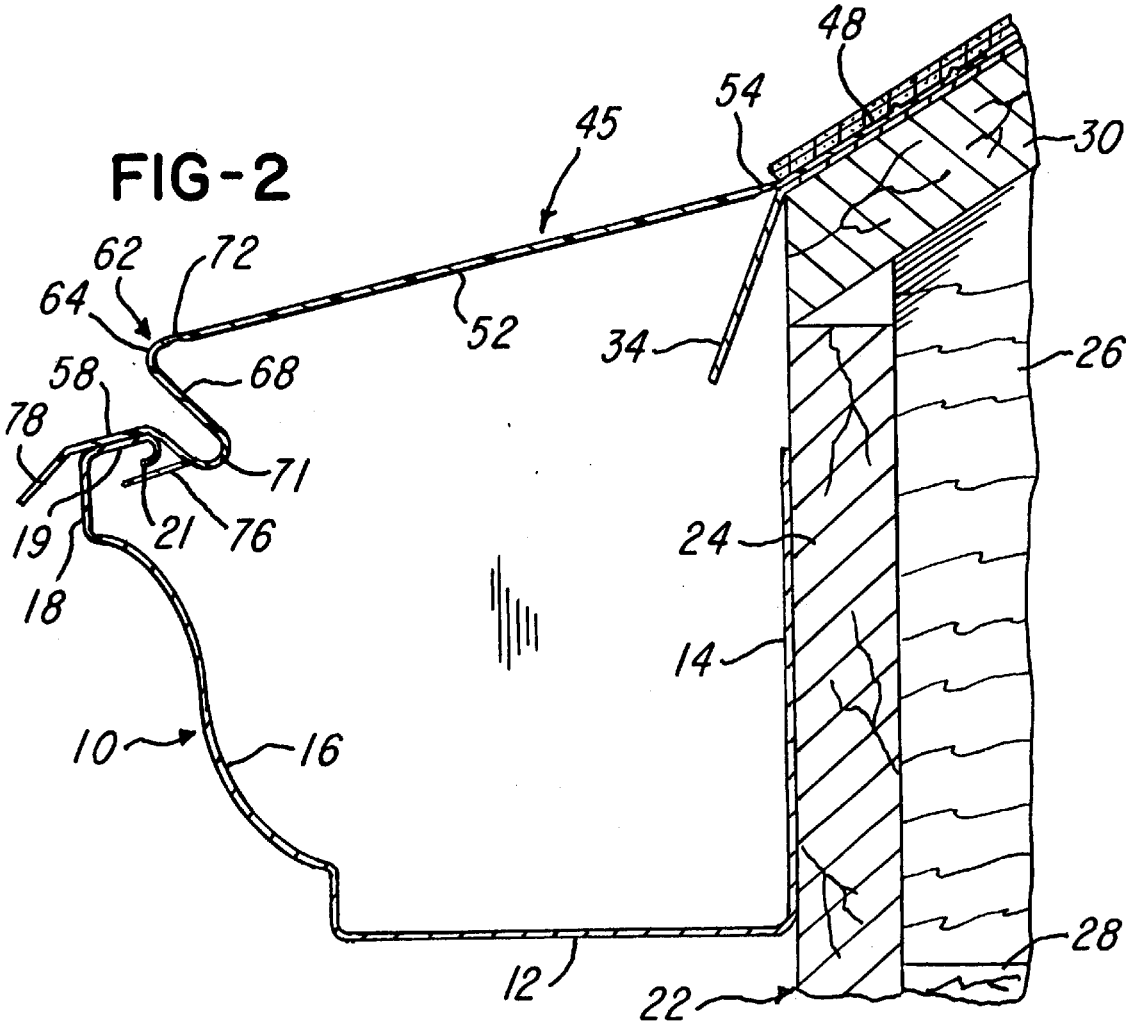
FIG. 2 is an enlarged vertical section taken generally on the line 2–2 of FIG. 1 and showing the gutter cover installed on a gutter positioned at one elevation relative to the roof covering.

FIG. 1 illustrates a portion of a conventional continuous-type rain gutter which is commonly roll-formed from an aluminum strip having an outer surface pre-finished with a baked enamel coating which may be white, beige or another color. As shown in FIG. 2, the rain gutter 10 includes a flat horizontal bottom wall 12 which integrally connects a flat vertical or rear wall 14 to a curved or contoured front wall 16. The front wall 16 has an upper edge or channel portion 18 which includes a return flange 19 terminating with a reverse tab or lip 21. The rain gutter 10 is shown in FIGS. 1 & 2 installed on a typical eave 22 of a residential building.

Commonly, the eave 22 includes a fascia board 24 which is nailed to the ends of a series of horizontally spaced rafters 26 which support a horizontal soffit board 28 and sloping roof sheeting or boards 30. The sheeting 30 is usually covered by a layer of felt (not shown) and a roof covering such as overlapping asphalt shingles 32. An angularly formed sheet metal drip strip 34 is commonly installed on the roof sheeting 30 under the shingles 32 for normally directing water draining from the shingles into the rain gutter 10. A common means of securing the gutter 10 to the fascia board 24 is disclosed in the above mentioned '965 patent, the disclosure of which is herein incorporated by reference, but other means are also used.

A continuous gutter cover is formed by a series of elongated cover sections or strips 45 each cut from an extrusion of semi-rigid plastics material such as polyvinyichloride. Each cover section or strip 45 has a predetermined length, for example, 3 or 4 feet, and includes a generally flat inner portion 48 which is relatively stiff and has a generally uniform thickness, for example, about 0.040". The inner portion 48 is adapted to slide under the roof covering or shingles 32 as shown in FIG. 1. Each cover strip 45 also includes a generally flat first intermediate portion 52 which also has a generally uniform wall thickness, for example, about 0.040". The first intermediate portion 52 is integrally connected to the inner portion 48 by a longitudinally extending flexible section 54 having a thickness substantially thinner than the portions 48 and 52, for example, on the order of 0.015" to 0.025". The thin extruded section 54 forms a second flexible hinge integrally connecting the cover strip portions 48 and 52.

In accordance with the present invention, the generally flat and solid intermediate portion 52 is integrally connected to an outer flange portion 58 by a second intermediate portion 62 having generally an S-shaped cross-sectional configuration. The second intermediate portion 62 has a rounded nose portion 64 and an inclined channel portion 68 having a bottom wall with longitudinally spaced openings or slots 71. A thin flexible section 72, similar to the thin flexible section 54, forms a first flexible hinge integrally connecting the first intermediate portion 52 with the second intermediate portion 62. While the thin flexible integral hinge section 72 is shown close to or adjacent the nose 64, the section 72 may be at the nose or further up the intermediate portion 52.

The outer flange portion 58 seats on and is supported by the return flange portion 19 of the front gutter wall 16, and a longitudinal extending retaining flange 76 is extruded as an integral part of the channel portion 68 and projects outwardly under the outer flange portion 58 for receiving or capturing the reverse lip 21 of the front gutter wall 16 to secure or hook each cover strip 45 to the upper channel portion 18 of the gutter 10. As also disclosed in the above-mentioned '965 patent, the outer flange portion 58 of the strip 45 preferably projects outwardly from the channel portion 18 of the gutter 10 to form a downwardly and outwardly projecting lip portion 78 for directing leaves and other debris received on the outer flange portion 58 to the ground and thereby prevent the debris from running down and collecting on the front wall 16 of the gutter. Preferably, the retaining flange 76 is extruded substantially thinner than the strip portions 52 and 58 and is flexible or is integrally connected to the channel portion 68 by the thin hinge section so that the retaining flange 76 will accommodate reverse tabs 21 of different widths and/or at different angles.

Figure 3:
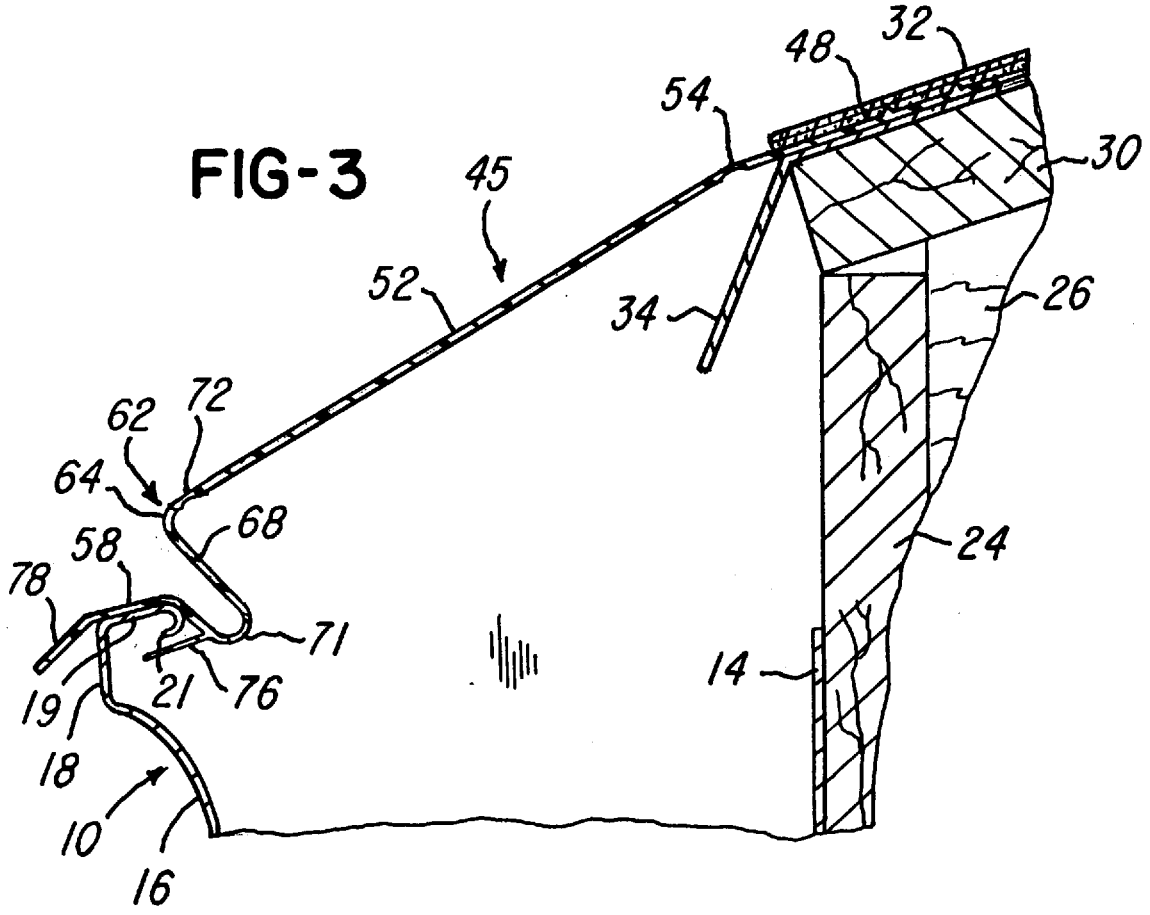
FIG. 3 is a vertical section similar to FIG. 2 and showing the gutter cover of the invention installed on the low end of a sloping gutter.
Figure 4:
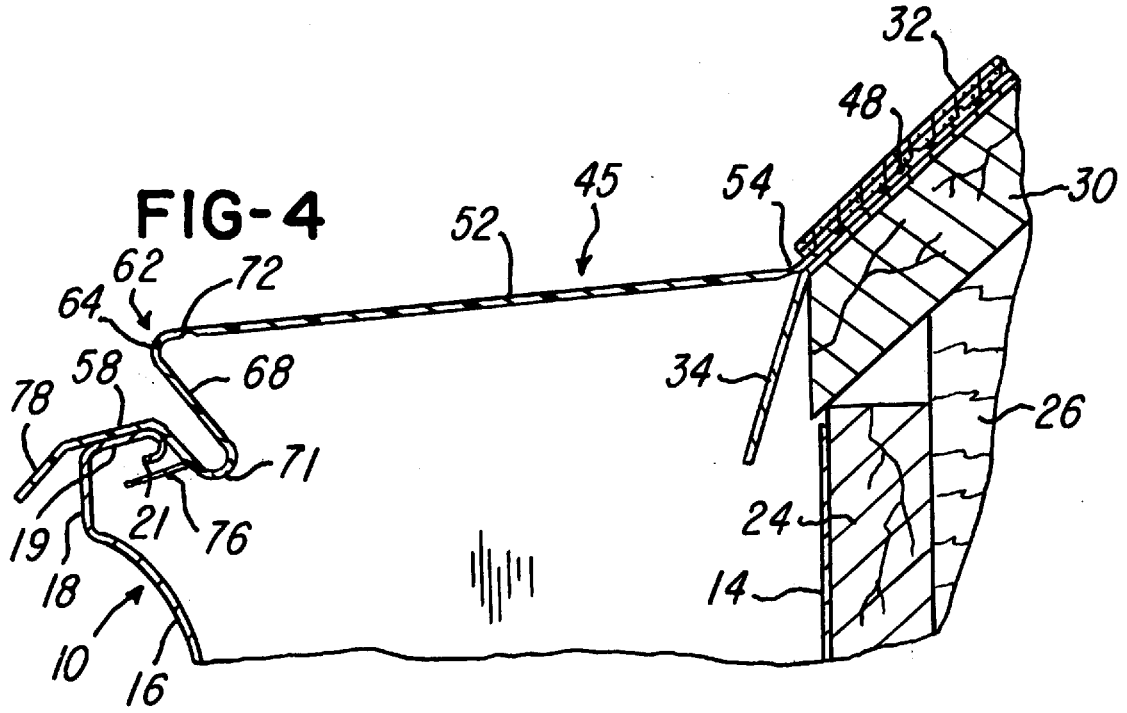
FIG. 4 is a fragmentary section similar to FIG. 3 and showing the gutter cover of the invention installed on the high end of a sloping gutter and with a roof having a higher pitch than the roof shown in FIGS. 1 & 2.

Referring to FIGS. 2–4, it is apparent that the flexible integral hinge section 72 permits the first generally flat intermediate portion 52 to be flexed relative to the second intermediate portion 62 so that a series of cover strips 45 may accommodate a sloping gutter with a changing elevation relative to the roof covering 32 without changing the angular position of the second intermediate portion 62 and the outer flange portion 58 relative to the channel portion 18 of the gutter 10. As a result, the outer flange portions 58 and the intermediate portions 62 of the cover strips 45 remain in the same position along the entire length of the front gutter wall 16, both at the low end of the gutter (FIG. 3) and at the high end of the gutter (FIG. 4) and all locations in between. Thus the rainwater flowing down the generally flat and aligned first intermediate portions 52 of the strips flows uniformly into the channel portions 68 and into the gutter along the entire length of the gutter. In addition, the position of the noses 64 of the aligned cover strips 45 remains uniform above the outer flange portions 58 on all of the cover strips 45 regardless of the pitch of the first intermediate portion 52 so that leaves and other debris are directed onto the outer flange portions 58 and to the ground from the projecting lips 78. It is also apparent from FIGS. 3 and 4 that the integral hinge section 54 permits the inner flange portion 48 of each cover strip 45 to be flexed according to the pitch of the roof sheeting 30 and roof covering 32.

While the form of gutter cover device or strip herein described constitutes a preferred embodiment of the invention, it is to be understood that the invention is not limited to this precise form of device, and that changes may be made therein without departing from the scope and spirit of the invention as defined in the appended claims. For example, the strip 45 may be roll-formed or stamped from sheet metal, such as the aluminum used to form the gutter 10, and the thin hinge sections 54 and 72 may each be formed by scoring or forming a line of weakening within the sheet metal or aluminum.

What is claimed is:

1. In a device for deflecting leaves and other debris over an elongated open top rain gutter having a front wall with an upper edge portion and for directing water draining from a roof covering into the gutter, said device including an elongated extrusion of substantially rigid plastics material and forming a one-piece and substantially rigid cover strip including a longitudinally extending and substantially rigid generally flat inner portion adapted to project under the roof covering, said strip also including a generally flat and substantially rigid cover portion continuing outwardly from said inner portion to cover a substantial portion of the gutter and to direct water received from the roof covering over a substantial portion of the gutter, said strip also including a longitudinally extending and substantially rigid outer flange portion positioned to seat on the upper edge portion of the gutter, said strip further including a longitudinally extending and substantially rigid intermediate portion between said outer flange portion and said cover portion, said intermediate portion including a longitudinally extending nose disposed above said outer flange portion of said strip and a longitudinally extending channel portion having longitudinally spaced bottom openings disposed below said outer flange portion and adjacent the upper edge portion of the gutter, and said nose being effective to direct the water received from said cover portion of said strip downwardly into said, channel portion and through said openings into the gutter and for deflecting leaves and other debris outwardly onto said outer flange portion of said strip, the improvement comprising a longitudinally extending first integral hinge section integrally connecting said rigid cover portion to said rigid intermediate portion and having a thickness substantially thinner than the thickness of said cover portion and the thickness of said intermediate portion, said first integral hinge section providing for pivoting said cover portion relative to said intermediate portion while maintaining the position of said rigid outer flange portion and said rigid intermediate portion relative to the gutter, a longitudinally extending second integral hinge section integrally connecting said rigid cover portion of said strip to said rigid inner portion of said strip and having a thickness substantially thinner than the thickness of said cover portion and the thickness of said inner portion, said second hinge section providing for pivoting said inner portion of said strip relative to said cover portion for accommodating different roof pitches, and said first and second hinge sections cooperating for accommodating a sloping gutter and gutters at different elevations relative to the roof covering while maintaining the position of said outer flange portion and said intermediate portion relative to said gutter.

2. A device as defined in claim 1 wherein said first integral hinge section extends in parallel spaced relation to said nose.

* * * * *